US007641506B2

(12) United States Patent
Sacher et al.

(10) Patent No.: US 7,641,506 B2
(45) Date of Patent: Jan. 5, 2010

(54) ELECTRICAL CONNECTION DEVICE AND CONNECTOR

(75) Inventors: Robert Sacher, Birr (CH); Wolfgang Knapp, Lenzburg (CH)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 12/405,277

(22) Filed: Mar. 17, 2009

(65) Prior Publication Data

US 2009/0239408 A1 Sep. 24, 2009

(30) Foreign Application Priority Data

Mar. 18, 2008 (EP) ..... 08152900

(51) Int. Cl.
*H01R 13/00* (2006.01)

(52) U.S. Cl. ..... 439/485

(58) Field of Classification Search ..... 439/376, 439/485, 196, 18, 700
See application file for complete search history.

(56) References Cited

U.S. PATENT DOCUMENTS

| | | | | |
|---|---|---|---|---|
| 5,080,593 | A | 1/1992 | Neumann et al. | |
| 5,505,167 | A * | 4/1996 | Kennedy | 123/41.84 |
| 5,584,490 | A * | 12/1996 | Inoue et al. | 277/595 |
| 5,616,973 | A * | 4/1997 | Khazanov et al. | 310/54 |
| 5,636,684 | A | 6/1997 | Teytu et al. | |
| 2003/0045150 | A1 | 3/2003 | Krause | |
| 2006/0035488 | A1 | 2/2006 | Bosco et al. | |

FOREIGN PATENT DOCUMENTS

| | | |
|---|---|---|
| DE | 1 266 383 B | 4/1968 |
| DE | 88 01 086 U1 | 3/1988 |
| EP | 0 005 429 A1 | 11/1979 |
| EP | 0 401 640 A1 | 12/1990 |
| EP | 0 720 420 A1 | 7/1996 |
| EP | 1 289 074 A2 | 3/2003 |
| EP | 1 833 123 A1 | 9/2007 |

OTHER PUBLICATIONS

European Search Report (with English language translation of category of cited documents) dated Aug. 28, 2008.

* cited by examiner

*Primary Examiner*—Neil Abrams
*Assistant Examiner*—Phuong Nguyen
(74) *Attorney, Agent, or Firm*—Buchanan Ingersoll & Rooney PC

(57) ABSTRACT

The disclosure relates to a connection device, in particular a heavy-duty plug-type connection, with a first connector and a second connector, which each have a contact-making element in order to produce an electrical connection in the connected state of the connectors; the connectors bearing against one another at a connection region in the connected state; at least one of the connectors comprising a coolant line with one or more access points for the supply and discharge, respectively, of a coolant; the coolant line being provided at the contact-making element in order to dissipate heat from a contact point between the contact-making elements; all of the access points of the coolant line being arranged outside of the connection region.

16 Claims, 3 Drawing Sheets

ELECTRICAL CONNECTION DEVICE AND CONNECTOR

RELATED APPLICATION

This application claims priority under 35 U.S.C. §119 to European Patent Application No. 08152900.0 filed in Europe on Mar. 18, 2008, the entire content of which is hereby incorporated by reference in its entirety.

TECHNICAL FIELD

The disclosure relates to an electrical connection device and to a connector, in particular for producing electrical connections for conducting high currents.

BACKGROUND INFORMATION

Electrical plug-type connections have a wide variety of uses. They make it possible to connect electrical devices or assemblies by manually joining together mutually complementary connection elements. In order that said elements can be joined together without a large amount of force being used, the required plug-in forces are designed to be as low as possible. However, this means that the contact force in such plug-type connections is lower than is the case in screw-type connections or clamping connections, for example.

A lower contact force in plug-type connections results in increased contact resistance at the contact point, at which a power loss is produced in the event of a current flow owing to the voltage drop. This results in heating at the contact point of the plug-type connection, which can result in accelerated contact degradation as a result of oxidation or a change to the structure of the contact materials used and ultimately in thermal destruction of the contacts.

A possible way of avoiding the disadvantages of excessive heating of the contact point consists in cooling of the plug-type connector. For example, the document US 2006/035488 specifies an air-cooled plug, which is intended to reduce the heating of the contact point. The plug has cooling laminates, which are thermally connected to the contacts. One disadvantage is the fact that the cooling laminates have a negative effect on the physical size of the plug and another is the fact that they make insulation of the plug more difficult.

Improved cooling of the contact point is achieved if the plug-type connection is cooled with a liquid coolant, e.g., water. The document EP 0 401 640 has disclosed such a liquid-cooled plug-type connection with complementary connection elements. During assembly, there is both an electrical connection and a coolant connection produced between the connection elements. The coolant connection exists, in the connected state, as a coolant line through the plug-type connection.

However, one disadvantage is the fact that the coolant channel is also opened, as well as the current path, when the plug-type connection is disconnected, with the result that the liquid coolant needs to be removed before the disconnection.

SUMMARY

Exemplary embodiments disclosed herein can provide an improved connection device which has sufficient cooling at a contact point of a connector, has a low space requirement and can be joined together and disconnected without any preparatory measures.

A connection device for a heavy-duty plug-type connection is disclosed. Such a connection device has a first connector and a second connector, which each have a contact-making element in order to produce an electrical connection in the connected state of the connectors; the connectors bearing against one another at a connection region in the connected state; at least one of the connectors comprising a coolant line with one or more access points for the supply and discharge, respectively, of a coolant; the coolant line being provided at the contact-making element in order to dissipate heat from a contact point between the contact-making elements. All of the access points of the coolant line are arranged outside the connection region. The first connector comprises a housing with a contact-making element accommodated therein, a section of the coolant line being formed between the housing and the contact-making element, the housing having a passage for accommodating the contact-making element of the second connector, the passage being formed in such a way that it is closed in the connected state by means of the contact-making element of the second connector so as to prevent the eergence of the coolant, and a closure element being provided in order to close the passage in the non-connected state so as to prevent the emergence of the coolant.

A connection device for a heavy-duty plug-type connection is disclosed. Such a connection device has a first connector and a second connector, which each have a contact-making element in order to produce an electrical connection in the connected state of the connectors; the connectors bearing against one another at a connection region in the connected state; at least one of the connectors comprising a coolant line with one or more access points for the supply and discharge, respectively, of a coolant; the coolant line being provided at the contact-making element in order to dissipate heat from a contact point between the contact-making elements. All of the access points of the coolant line are arranged outside the connection region. The coolant line is arranged in a separate cooling unit, which is fastened on the contact-making element of the at least one connector.

An electrical connector, in particular a heavy-duty plug, for producing an electrical connection is disclosed. Such an electrical connector comprises: a contact-making element in order to make contact with a further contact-making element of a further connector in a connected state so as to produce the electrical connection; a connection region, which is provided to bear, in the connected state, on a corresponding further connection region of the further connector; and a coolant line with one or more access points for the supply and discharge, respectively, of a coolant; the coolant line being provided at the contact-making element in order to dissipate heat from a contact point at the contact-making element. All of the access points of the coolant line are arranged outside of the connection region, and a housing with a contact-making element accommodated therein is provided, with a section of the coolant line being formed between said housing and said contact-making element, the housing having a passage for accommodating the contact-making element of the further connector, a closure element being provided in order to close, in the non-connected state, the passage so as to prevent the emergence of the coolant.

An electrical connector, in particular a heavy-duty plug, for producing an electrical connection is disclosed. Such an electrical connector comprises: a contact-making element in order to make contact with a further contact-making element of a further connector in a connected state so as to produce the electrical connection; a connection region, which is provided to bear, in the connected state, on a corresponding further connection region of the further connector; and a coolant line with one or more access points for the supply and discharge, respectively, of a coolant; the coolant line being provided at the contact-making element in order to dissipate heat from a contact point at the contact-making element. All of the access points of the coolant line are arranged outside of the connection region. The coolant line is arranged in a separate cooling unit, which is fastened on the contact-making element.

In another aspect, a method of providing a heavy-duty plug-type connection is disclosed. Such a method is based on a connection device having a first connector and a second connector, which each have a contact-making element in order to produce an electrical connection in the connected state of the connectors; the connectors bearing against one another at a connection region in the connected state. The method comprises providing with at least one of the connectors a coolant line with one or more access points for the supply and discharge, respectively, of a coolant, the coolant line being provided at the contact-making element in order to dissipate heat from a contact point between the contact-making elements; arranging all of the access points of the coolant line outside the connection region; and arranging the coolant line in a separate cooling unit, which is fastened on the contact-making element of the at least one connector.

BRIEF DESCRIPTION OF THE DRAWINGS

Exemplary embodiments of the disclosure will be explained in more detail below with reference to the attached drawings, in which.

In the drawings, the same reference numerals denote elements with an identical or similar function.

DETAILED DESCRIPTION

Figure 1A:
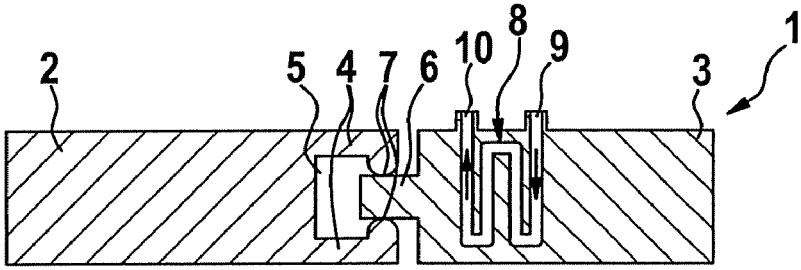
FIGS. 1*a* and 1*b* show a schematic illustration of a plug-type connection, in which connection element is provided with a coolant line, in a connected and a non-connected state.

In accordance with a first aspect, a connection device, in particular a heavy-duty plug-type connection, is provided. The connection device comprises a first connector and a second connector, which each have a contact-making element in order to produce an electrical connection in the connected state of the connectors. The connectors bear against one another at a connection region in the connected state. At least one of the connectors comprises a coolant line with one or more access points for the supply and discharge, respectively, of a coolant. The coolant line is coupled to the contact-making element in order to dissipate heat from a contact point between the contact-making elements. All of the access points of the coolant line are arranged outside of the connection region.

One aspect of the disclosure provides a coolant line in at least one of the connectors for the connection device, which coolant line is not impaired by the connection device being disconnected and assembled, with the result that the coolant remains within the respective connector irrespective of whether the connection device is in the connected or non-connected state. The coolant line is arranged close to the contact point of the connection device, with the result that heat generated there is transported away by a coolant moving through the coolant line.

Furthermore, the first connector can be in the form of a female connector and the second connector can be in the form of a male connector.

In accordance with one exemplary embodiment, the coolant line is arranged in a separate cooling unit, which is fastened on the contact-making element of the at least one connector.

The first connector comprises a housing with a contact-making element accommodated therein, with a section of the coolant line being formed between said housing and said contact-making element. The housing has a passage for accommodating the contact-making element of the second connector, the passage being designed in such a way that it is closed, in the connected state, by the contact-making element of the second connector so as to prevent the emergence of the coolant. A closure element is furthermore provided in order to close the passage in the non-connected state so as to prevent the emergence of the coolant.

Furthermore, the closure element can be prestressed by a spring element, which presses the closure element, in the non-connected state, against a stop into the passage in order to close said passage.

The contact-making element of the second connector can have, for example, a cylindrical form.

The passage can be provided with a sealing element in order to seal off the passage so as to prevent the emergence of the coolant.

In accordance with another exemplary embodiment, a further section of the coolant line is formed within the contact-making element.

In accordance with a further aspect, an electrical connector, in particular a heavy-duty plug, for producing an electrical connection is provided. The electrical connector comprises a contact-making element in order to make contact with a further contact-making element of a further connector in a connected state so as to produce the electrical connection. A connection region, is provided to bear, in the connected state, on a corresponding further connection region of the further connector. The connector furthermore has a coolant line with one or more access points for the supply and discharge, respectively, of a coolant. The coolant line is coupled to the contact-making element in order to dissipate heat from a contact point at the contact-making element. All of the access points of the coolant line are arranged outside of the connection region.

Furthermore, the coolant line can be arranged in a separate cooling unit, which is fastened on the contact-making element.

In accordance with one exemplary embodiment, a housing with a contact-making element accommodated therein is provided, with a section of the coolant line being formed between said housing and said contact-making element, the housing having a passage for accommodating the contact-making element of the further connector. In the non-connected state, the passage can be closed with the aid of a closure element so as to prevent the emergence of the coolant.

Furthermore, the closure element can be prestressed by a spring element, which presses the closure element, in the non-connected state, against a stop into the passage.

In accordance with a further aspect, a connection module with the one or more electrical connectors above is provided, which connectors are coupled to a coolant pump and a heat exchanger via coolant lines.

Figure 1B:
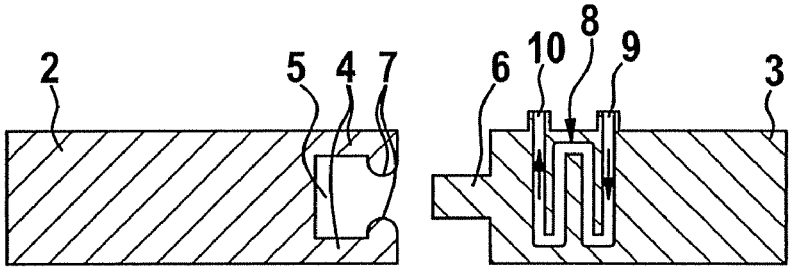

FIGS. 1*a* and 1*b* show a plug-type connection 1 with a first connection element (connector) 2 and a second connection element 3 in a plugged-together or joined (connected) state (FIG. 1*a*) and in a separated (non-connected) state (FIG. 1*b*).

The first connection element 2 has two mutually opposite contact arms 4, which are arranged around a cutout 5. The contact arms 4 have two contact-making regions 7, which are arranged as elevations pointing towards one another on the two contact arms 4. The second connection element 3 has a contact pin 6.

The contact pin 6 of the second connection element 3 can be inserted into the cutout 5 of the first connection element 2, with the result that the contact-making regions 7 of the contact arms 4 slide along the contact pin 6 and, in the completely connected state, bear against respective contact faces of the contact pin 6. When the two connection elements 2, 3 are plugged together, the contact arms 4 are deflected elastically, with the result that the contact-making regions 7 are pressed with a certain contact force against the respective contact face of the contact pin 6. As a result, an electrical connection at a contact point between the contact arms 4 and the contact pin 6 of the two connection elements 2, 3 is produced in a connection region.

Generally, the connection elements 2, 3, i.e. the distance between the contact-making regions 7, the elasticity of the contact arms 4 and the thickness of the contact pin 6, are designed in such a way that it is possible to manually plug together the two connection elements 2, 3 without a large amount of force. However, this limits the possible contact force between the contact-making regions 7 and the contact pin 6.

The contact force at the contact point between the contact-making region 7 and the contact pin 6 is a critical measure determining the contact resistance which in turn substantially influences the overall resistance of the plug-type connection. A considerable power loss in the form of heat therefore arises in particular at the contact point in the event of a high current flow through the plug-type connection. In order that the heat does not result in degradation or destruction of the contact-making region 7 and/or of the contact pin 6, said heat therefore needs to be dissipated in a suitable manner.

In order to dissipate the heat, in the case of the plug-type connection in FIGS. 1*a* and 1*b* the disclosure provides that a cooling device is integrated in the second connection element 3, which cooling device is in the form of a coolant line 8. The coolant line 8 has an inlet opening 9 and an outlet opening 10, via which the coolant is supplied and discharged. During operation of the plug-type connection 1, the coolant is guided through the coolant line 8, with the result that heat located in the second connection element is dissipated.

The inlet opening 9 and the outlet opening 10 are arranged on the second connection element 3 in such a way that they are accessible irrespective of the connection state of the plug-type connection 1. That is to say that, when the connection elements 2, 3 are plugged together or joined together, neither the inlet opening 9 nor the outlet opening 10 of the coolant line 8 located in the second connection element 3 is covered or accommodated in the first connection element 2. Furthermore, there is also no coolant line which runs from the first connection element 2 to the second connection element 3. This makes it possible to disconnect the plug-type connection without first stopping the coolant cycle and/or without the coolant being let out of the connection element 3.

In the exemplary embodiment shown in FIGS. 1*a* and 1*b*, the inlet opening 9 and the outlet opening 10 are arranged on a side face of the second connection element 3, which side face extends substantially parallel to the direction in which the connection elements 2, 3 are joined together. It is also possible for the inlet opening 9 and the outlet opening 10 to be arranged on respectively different side faces of the second connection element 3 or on a rear side of the second connection element 3, which is opposite the contact pin 6.

The coolant line 8 can be arranged in loops in the second connection element 3, with the result that the coolant line 8 extends in meandering fashion in the second connection element 3. As a result, the interface between the coolant line 8 and the surrounding material is increased, with the result that improved heat dissipation is possible.

Figure 2A:
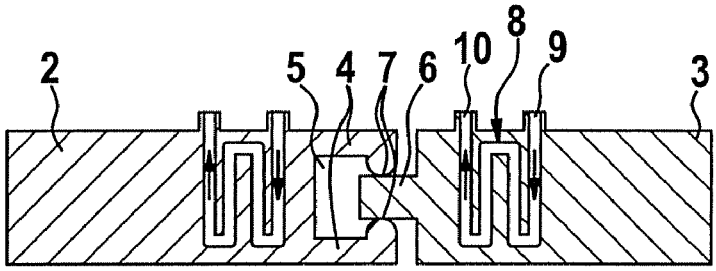
FIGS. 2*a* and 2*b* show a schematic illustration of a plug-type connection, in which two complementary connection elements are provided with coolant lines, in a connected and a non-connected state.
Figure 2B:
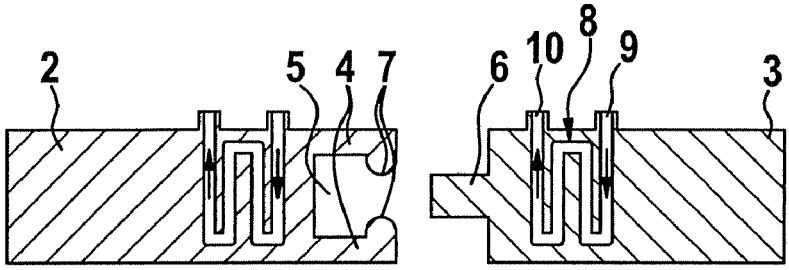

As is shown in FIGS. 2*a* and 2*b*, the two connection elements 2, 3 can be equipped with corresponding coolant line 8, with the result that cooling can take place both via the contact pin 6 of the second connection element 3 and via the contact arms 4 of the first connection element 2. The coolant line 8 can be designed to be identical or different. Of course it is also possible for only the first connection element 2 to be provided with the coolant device. In the case of the provision of only one cooling device, said cooling device should be provided in the connection element 2, 3 in which better heat dissipation from the contact point to the cooling device is ensured.

Figure 3A:
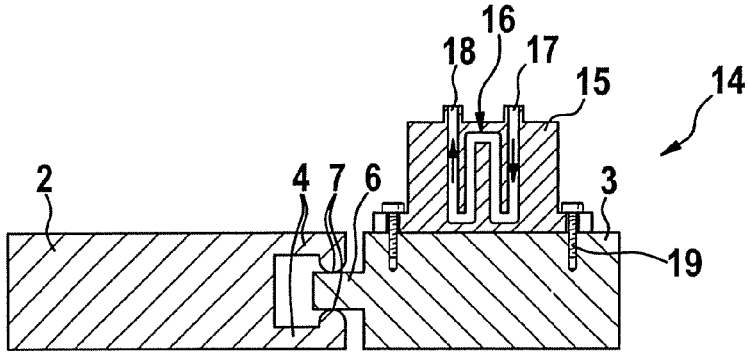
FIGS. 3*a* and 3*b* show a schematic illustration of a plug-type connection, in which a cooling unit with a coolant line as a separate element is fitted on a connection element, in a connected and a non-connected state.
Figure 3B:
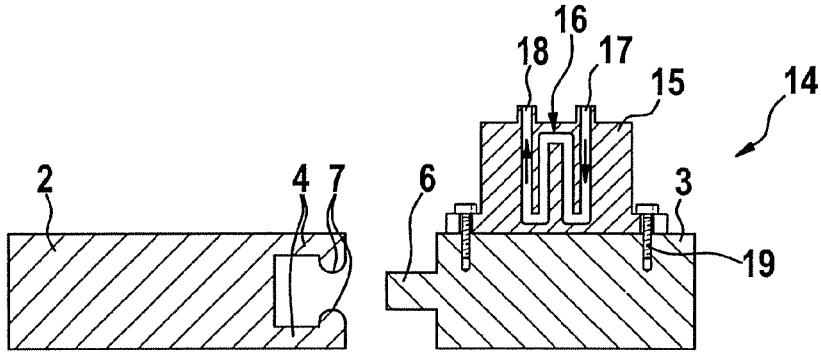

FIGS. 3*a* and 3*b* show a further variant of a plug-type connection 14 in the plugged-together state (FIG. 3*a*) and in the disconnected state (FIG. 3*b*). In the plug-type connection 14 in FIGS. 3*a* and 3*b*, a cooling device in the form of a separate cooling element 15 made from a highly thermally conductive material is illustrated. The cooling element 15 is fastened on one of the connection elements 2, 3, with the result that heat can be dissipated from the contact point between the contact arm 4 and the contact pin 6 via the cooling element 21.

The cooling element 15 has a coolant line 16, through which coolant is introduced via an inlet opening 17 and coolant is passed out via an outlet opening 18. The coolant line 16 can have loops in order to increase the interface between the coolant line 16 and the material of the cooling element 15, with the result that the heat dissipation from the material of the cooling element 15 is improved. As an alternative or in addition, further measures for enlarging the interface between the coolant line 16 and the material of the cooling element 15, such as laminates or the like, for example, can be provided.

The cooling element 15 is fastened on the second connection element 3 with as low a thermal resistance as possible. The fastening can take place, for example, by means of adhesive-bonding or another mechanical connection, such as by means of a clamping connection or a screw-type connection 19, for example.

In a further exemplary embodiment, the plug-type connection 14, which is shown in FIGS. 3*a* and 3*b*, can also have a corresponding cooling element 15 on the two connection elements 2, 3.

Figure 4A:
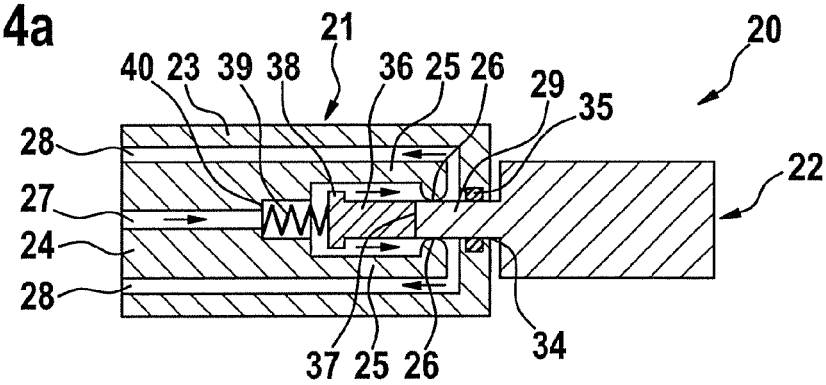
FIGS. 4*a* and 4*b* show a schematic illustration of a plug-type connection, in which the coolant flows directly around the contact point, in a connected and a non-connected state.
Figure 4B:
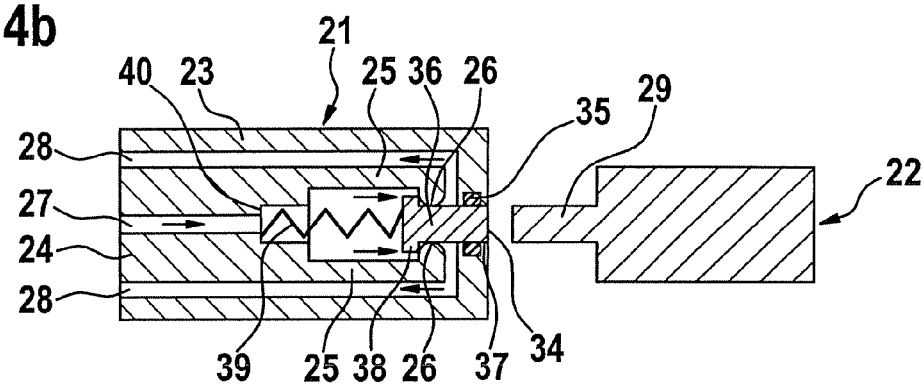

FIGS. 4*a* and 4*b* illustrate a further plug-type connection 20. The further plug-type connection 20 comprises a first connection element 21, which can be connected to a complementary second connection element 22. The first connection element 21 comprises a housing 23, in which an electrically conductive conductor element 24 is arranged fixedly. The cross section of the housing 23 may be circular-cylindrical or quadrilateral or have another form.

The conductor element 24 has contact arms 25, which are each provided with a contact-making region 26. The contact arms 25 surround a cutout, in which a contact pin 29 of the second connection element is accommodated in the connected state of the further plug-type connection 20. The contact-making region 26, in the connected state of the further plug-type connection 20, makes contact with the contact pin 29 at a contact point and thus produces the electrical connection. In the embodiment in FIGS. 4*a* and 4*b*, the faces at which the connection elements 21, 22 bear against one another in the connected state represent the connection region.

In the conductor element 24, a first coolant line section 27 for conducting a coolant is provided. An interspace between an inner wall of the housing 23 and the conductor element 24 is furthermore used as a second coolant line section 28, through which the coolant is conducted. The second coolant line section 28 can be provided so as to run around the periphery (tangentially with respect to the connection direction) or only at certain regions. A part of the second coolant line section 28 can be formed between the housing 23 and one or more of the contact arms 25 in order to be able to dissipate the heat generated at the contact point as efficiently as possible. The first coolant line section 27 and the second coolant line section 28 are parts of the coolant line through which a coolant is conducted in order to dissipate heat generated at the contact point. The direction of flow of the coolant in the coolant line sections 27, 28 is essentially as desired.

The housing 23 has a passage in the form of an accommodating opening 34, by means of which the contact pin 29 of the second connection element 22 can be accommodated into the cutout when the connection elements 21, 22 are plugged together. The accommodating opening 34 has substantially the cross section of the contact pin 29, with the result that the contact pin 29 can be accommodated in the accommodating opening 34 with little play. The accommodating opening 34 can furthermore be provided with a sealing element 35 in order to seal off the accommodating opening 34 so as to prevent a loss of coolant if the contact pin 29 is accommodated therein.

The contact pin 29, in the connected state of the further plug-type connection 20, reaches through the accommodating opening 34 between the contact arms 25, with the result that the contact-making regions 26 of the contact arms 25 make contact with the contact pin 29 and press with a certain contact force laterally (with respect to the connection direction) onto the contact pin 29. The contact force can be produced, for example, by an elastic deflection of the contact arms 25 when the contact pin 29 is accommodated.

In order to avoid coolant provided in the coolant line flowing out in the disconnected state of the further plug-type connection 20, a closure element 36 is provided which has a closure section 37 and a stop 38. The closure element 36 acts as a closure for the accommodating opening in the disconnected state of the further plug-type connection 20.

The closure section 37 is pressed into the accommodating opening 34 of the housing 23 with the aid of a spring 39, the stop 38 of the closure element 36 ensuring that the closure element 36 remains in the housing 23. In the uncoupled state of the further plug-type connection 20, the stop 38 can bear against the conductor element 24, for example by means of a suitable restraining element. Alternatively, the contact-making region 26 of one or both contact arms 25 can act as the restraining element for the closure element 36.

The spring 39 is arranged between the closure element 36 and a holding edge 40 on the conductor element 24 and can be prestressed. The holding edge 40 can be formed, for example, by a stepped enlargement of the cross section of the first coolant line section 27.

When the connection elements 21, 22 are plugged together, an end face of the contact pin 29 presses onto an end face of the closure element 36 and presses the latter into the cutout of the first connection element 21 against the spring force exerted by the spring 39. In this case, the end faces bear flush against one another. As a result, the contact pin 29 replaces the closure element 36 in the accommodating opening 34 of the housing 23, wherein at no point in time is it is possible for coolant to flow out of the housing 23 through the accommodating opening 34. Alternatively, the end faces of the closure element 36 and the contact pin 29 can be provided with a mutually complementary topology, in particular can have complementary conical forms in order to avoid the end faces sliding away from one another when the connection elements are plugged together.

The closure element 36, as is the housing 23, can be formed from an electrically nonconductive material, with the result that sufficient insulation can be achieved in the disconnected state of the further plug-type connection 20.

Figure 5:
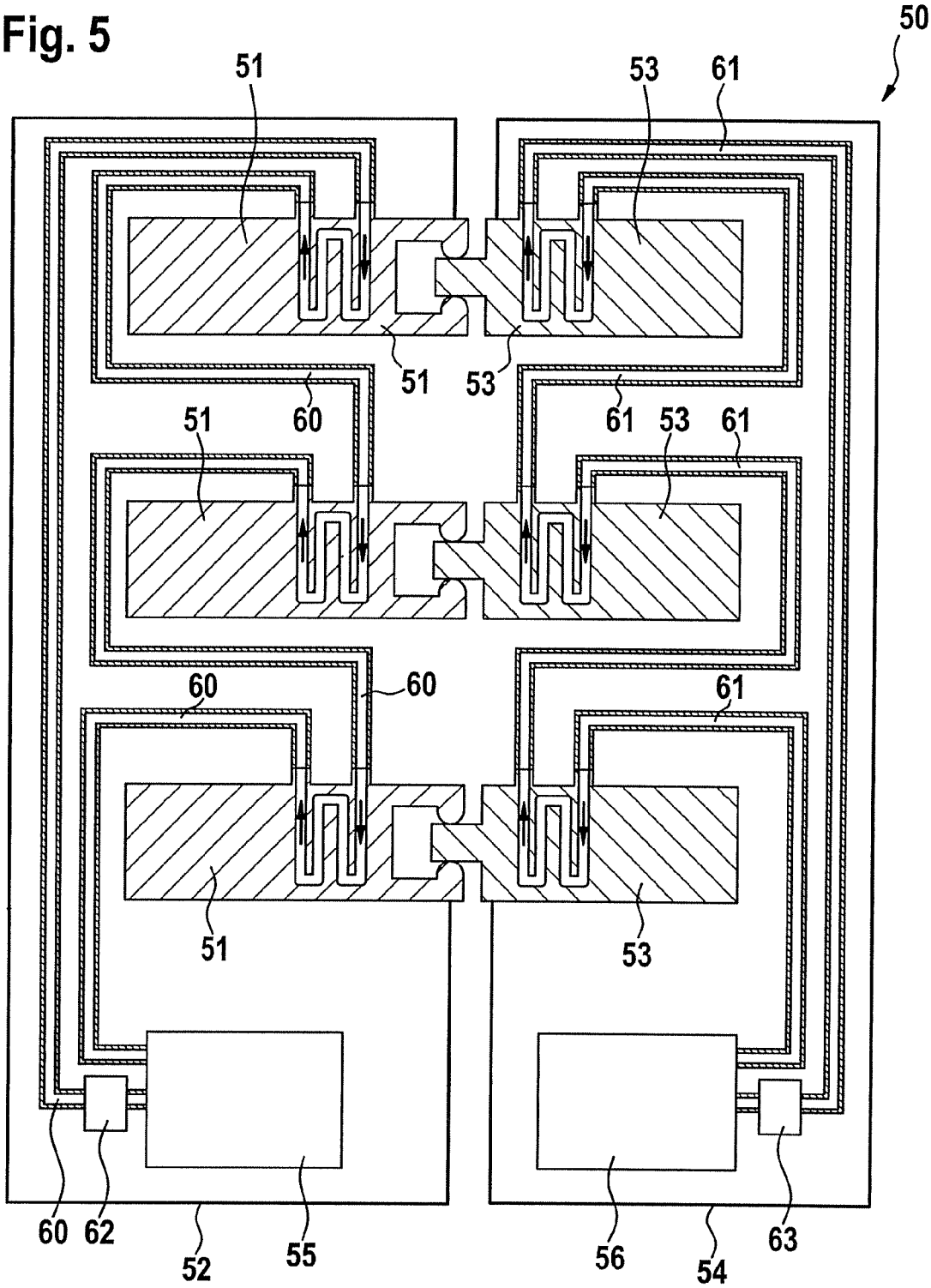
FIG. 5 shows an illustration of a plug-type connection system with a plurality of plug-type connections, which are each connected to a coolant pump.

In FIG. 5, a connection system 50 with a plurality of plug-type connections is provided. First connection elements 51 are provided in a first connection module 52 and second connection elements 53 are provided in a second connection module 54. Each of the first and second connection elements 51, 53 can be constructed in one of the abovedescribed ways. The connection elements 51, 53 are arranged in the respective connection modules 52, 54 in such a way that they can be connected to a complementary connection module by being plugged in a connection direction.

The first connection elements 51 are coupled to a first coolant pump 55 via first coolant lines 60, with the result that the coolant channels in the individual first connection elements 51 of the first connection module 52 are connected in serial fashion with respect to the coolant cycle. The first coolant pump 55 can be arranged within the first connection module 52 or separately therefrom. The first coolant line 60 passes through a first heat exchanger 62 in order to dissipate the heat dissipated from the first connection elements 51.

The second connection elements 53 are coupled to a second coolant pump 56 via second coolant lines 61, with the result that the coolant channels in the individual second connection elements 53 of the second connection module 54 are likewise connected in serial fashion with respect to the coolant cycle. The second coolant pump 56 can be arranged within the second connection module 52 or separately therefrom. The second coolant line 61 passes through a second heat exchanger 63 in order to dissipate the heat dissipated from the second connection elements 53.

In order to ensure sufficient electrical insulation between the individual connection elements 51, 53 of a connection module 52, 54, nonconducting coolant lines 60, 61, or ones which are sufficiently insulated from the connection elements, and a nonconductive coolant can be used. In particular, electrically insulating liquids, such as water, oils, fluorinated liquids or the like, for example, can absorb a lot of heat and at the same time insulate high electrical voltages.

As an alternative to the configuration illustrated in FIG. 5, it is also possible for only one connection module 52, 54 of the connection system 50 to be provided with cooling devices or a coolant pump.

In accordance with a further exemplary embodiment, it is also possible for only one coolant pump 55 or 56 to be provided which ensures circulation of the cooling liquid through both connection modules 52, 54. The coolant pump 55 can then be arranged separately from the connection modules 52, 54 or in one of the two connection modules 52, 54. The connection modules 52, 54 then have corresponding additional disconnection points in the coolant line (forward flow and return flow) for complete disconnection as the interfaces.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1 Plug-type connection
2 First connection element
3 Second connection element
4 Contact arm
5 Cutout
6 Contact pin
7 Contact-making region
8 Coolant line
9 Inlet opening
10 Outlet opening
14 Plug-type connection
15 Cooling element
16 Coolant line
17 Inlet opening
18 Outlet opening
19 Screw-type connection
20 Plug-type connection
21 First connection element
22 Second connection element
23 Housing
24 Conductor element
25 Contact arms
26 Contact-making region
27 First coolant line section
28 Second coolant line section
29 Contact pin
34 Accommodating opening
35 Sealing element
36 Closure element
37 Closure section
38 Stop
39 Spring
50 Connection system
51 First connection element
52 First connection module
53 Second connection elements
54 Second connection module
55 First coolant pump
56 Second coolant pump
60 First coolant line
61 Second coolant line
62 First heat exchanger
63 Second heat exchanger

What is claimed is:

1. A connection device for a heavy-duty plug-type connection, with a first connector and a second connector, which each have a contact-making element in order to produce an electrical connection in the connected state of the connectors;

the connectors bearing against one another at a connection region in the connected state;

at least one of the connectors comprising a coolant line with one or more access points for the supply and discharge, respectively, of a coolant;

the coolant line being provided at the contact-making element in order to dissipate heat from a contact point between the contact-making elements;

wherein all of the access points of the coolant line are arranged outside the connection region, and wherein the first connector comprises a housing with a contact-making element accommodated therein, a section of the coolant line being formed between the housing and the contact-making element, the housing having a passage for accommodating the contact-making element of the second connector, the passage being formed in such a way that it is closed in the connected state by means of the contact-making element of the second connector so as to prevent the emergence of the coolant, and a closure element being provided in order to close the passage in the non-connected state so as to prevent the emergence of the coolant.

2. The connection device as claimed in claim 1, wherein the first connector is in the form of a female connector and the second connector is in the form of a male connector.

3. The connection device as claimed in claim 1, wherein the closure element is prestressed by a spring element, which presses the closure element in the non-connected state against a stop into the passage in order to close said passage.

4. The connection device as claimed in claim 3, wherein a further section of the coolant line is formed within the contact-making element.

5. The connection device as claimed in claim 3, wherein the contact-making element of the second connector has a cylindrical form.

6. The connection device as claimed in claim 5, wherein the passage is provided with a sealing element in order to seal off the passage so as to prevent the emergence of the coolant.

7. The connection device as claimed in claim 3, wherein the passage is provided with a sealing element in order to seal off the passage so as to prevent the emergence of the coolant.

8. The connection device as claimed in claim 7, wherein a further section of the coolant line is formed within the contact-making element.

9. A connection device for a heavy-duty plug-type connection, with a first connector and a second connector, which each have a contact-making element in order to produce an electrical connection in the connected state of the connectors;

the connectors bearing against one another at a connection region in the connected state;

at least one of the connectors comprising a coolant line with one or more access points for the supply and discharge, respectively, of a coolant;

the coolant line being provided at the contact-making element in order to dissipate heat from a contact point between the contact-making elements;

wherein all of the access points of the coolant line are arranged outside the connection region, and wherein the coolant line is arranged in a separate cooling unit, which is fastened on the contact-making element of the at least one connector.

10. The connection device as claimed in claim 9, wherein the first connector is in the form of a female connector and the second connector is in the form of a male connector.

11. An electrical connector, in particular a heavy-duty plug, for producing an electrical connection, comprising:

a contact-making element in order to make contact with a further contact-making element of a further connector in a connected state so as to produce the electrical connection;

a connection region, which is provided to bear, in the connected state, on a corresponding further connection region of the further connector; and a coolant line with one or more access points for the supply and discharge, respectively, of a coolant;

the coolant line being provided at the contact-making element in order to dissipate heat from a contact point at the contact-making element; wherein all of the access points of the coolant line are arranged outside of the connection region, and a housing with a contact-making element accommodated therein is provided, with a section of the coolant line being formed between said housing and said contact-making element, the housing having a passage for accommodating the contact-making element of the further connector, a closure element being provided in order to close, in the non-connected state, the passage so as to prevent the emergence of the coolant.

12. A connection module with one or more electrical connectors as claimed in claim 11, which are coupled to a coolant pump and a heat exchanger via coolant lines.

13. The connector as claimed in claim 11, wherein the closure element is prestressed by a spring element, which presses the closure element, in the non-connected state, against a stop into the passage.

14. A connection module with one or more electrical connectors as claimed in claim 13, which are coupled to a coolant pump and a heat exchanger via coolant lines.

15. An electrical connector, in particular a heavy-duty plug, for producing an electrical connection, comprising:

a contact-making element in order to make contact with a further contact-making element of a further connector in a connected state so as to produce the electrical connection;

a connection region, which is provided to bear, in the connected state, on a corresponding further connection region of the further connector; and a coolant line with one or more access points for the supply and discharge, respectively, of a coolant;

the coolant line being provided at the contact-making element in order to dissipate heat from a contact point at the contact-making element; wherein all of the access points of the coolant line are arranged outside of the connection region, and wherein the coolant line is arranged in a separate cooling unit, which is fastened on the contact-making element.

16. A method of providing a heavy-duty plug-type connection based on a connection device having a first connector and a second connector, which each have a contact-making element in order to produce an electrical connection in the connected state of the connectors; the connectors bearing against one another at a connection region in the connected state, the method comprising:

providing with at least one of the connectors a coolant line with one or more access points for the supply and discharge, respectively, of a coolant, the coolant line being provided at the contact-making element in order to dissipate heat from a contact point between the contact-making elements;

arranging all of the access points of the coolant line outside the connection region; and arranging the coolant line in a separate cooling unit, which is fastened on the contact-making element of the at least one connector.

* * * * *